US011089889B2

(12) United States Patent
Schorsch et al.

(10) Patent No.: US 11,089,889 B2
(45) Date of Patent: Aug. 17, 2021

(54) SELF ILLUMINATING PICTURE FRAME

(71) Applicant: John B. Schorsch, New York, NY (US)

(72) Inventors: John B. Schorsch, New York, NY (US); Paul Dowd, Scarsdale, NY (US); Joshua Goldin, Brooklyn, NY (US)

( * ) Notice: Subject to any disclaimer, the term of this patent is extended or adjusted under 35 U.S.C. 154(b) by 0 days.

(21) Appl. No.: 17/152,340

(22) Filed: Jan. 19, 2021

(65) Prior Publication Data

US 2021/0219747 A1 Jul. 22, 2021

Related U.S. Application Data

(60) Provisional application No. 62/962,300, filed on Jan. 17, 2020.

(51) Int. Cl.

| | |
|---|---|
| ***A47G 1/06*** | (2006.01) |
| ***F21V 5/04*** | (2006.01) |
| ***F21V 33/00*** | (2006.01) |
| *F21Y 115/10* | (2016.01) |

(52) U.S. Cl.

CPC ..... *A47G 1/0622* (2013.01); *F21V 5/045* (2013.01); *F21V 33/0024* (2013.01); *F21Y 2115/10* (2016.08)

(58) Field of Classification Search

CPC ... A47G 1/0622; F21V 33/0024; F21V 5/045; F21Y 2115/10

See application file for complete search history.

(56) References Cited

U.S. PATENT DOCUMENTS

| | | | | |
|---|---|---|---|---|
| 3,307,026 | A * | 2/1967 | Kramer | F21V 33/0032 362/191 |
| 9,810,403 | B2 * | 11/2017 | Wang | G02B 27/30 |
| 2002/0067591 | A1 * | 6/2002 | Tajima | H04N 9/12 361/679.21 |
| 2002/0139028 | A1 * | 10/2002 | Harlow | A47G 1/0616 40/728 |
| 2004/0226209 | A1 * | 11/2004 | Ayala | A47G 1/0622 40/714 |
| 2012/0154918 | A1 * | 6/2012 | Murayama | G02B 1/113 359/601 |

(Continued)

FOREIGN PATENT DOCUMENTS

| | | | | |
|---|---|---|---|---|
| CN | 2569276 | Y * | 8/2003 | |
| DE | 102009021035 | A1 * | 11/2010 | G03B 21/56 |
| EP | 1818694 | A1 * | 8/2007 | G02B 1/11 |

(Continued)

OTHER PUBLICATIONS

Machine English Translation of CN-2569276-Y; Hu (Year: 2003).*

*Primary Examiner* — Britt D Hanley
*Assistant Examiner* — Glenn D Zimmerman
(74) *Attorney, Agent, or Firm* — Keith D. Nowak; Carter, Ledyard & Milburn LLP

(57) ABSTRACT

A self-illuminating artwork frame including a light source and a collimating lens to provide a uniform level of illumination across the entire surface of the artwork displayed in the artwork frame. The artwork frame is comprised of four members and each member has two thin openings running along the front face of the member. In a preferred embodiment the light source and the collimating lens are placed in the thin openings of two opposing members.

10 Claims, 9 Drawing Sheets

(56) References Cited

U.S. PATENT DOCUMENTS

| | | | | |
|---|---|---|---|---|
| 2013/0208502 | A1* | 8/2013 | Nakayama | G02B 6/0016 362/608 |
| 2020/0183075 | A1* | 6/2020 | Mori | A63F 7/027 |

FOREIGN PATENT DOCUMENTS

| | | | | |
|---|---|---|---|---|
| WO | WO-9530979 | A1 * | 11/1995 | G09F 13/0413 |
| WO | WO-2019031215 | A1 * | 2/2019 | G02B 6/0036 |

* cited by examiner

SELF ILLUMINATING PICTURE FRAME

This application claims priority to U.S. Provisional Patent Application No. 62/962,300 filed Jan. 17, 2020, entitled "LIGHTING FRAME" and is hereby incorporated by reference in its entirety.

FIELD OF THE INVENTION

This invention relates generally to the field of illuminated picture frames and display frames, wherein lighting elements are incorporated within the frame assembly.

BACKGROUND OF THE INVENTION

Picture frames have been used for centuries to display works of art, including oil paintings, pastels, watercolors, and three-dimensional collages. More recently, picture frames are commonly used in nearly every home to display family pictures and the like.

There is no question that lighting is critical to fully appreciate whatever is displayed in a frame. Bad lighting destroys the appearance of the displayed artwork, while good lighting brings out the best features of the displayed artwork. The term "artwork" as used herein, means anything that may be displayed in the inventive frame.

There are a number of ways to provide lighting for the displayed artworks. This includes ceiling-mounted accent lights, track lights, and "wall washers", which create a bright wall where artwork is displayed. However, each of these options are expensive, require a substantial amount of lighting equipment, and most likely need to be installed by a lighting expert in order to achieve the lighting required to bring out the best in the displayed artwork.

A less expensive, but very effective lighting system, is to include the lighting in a frame used to hold the displayed artwork. This puts the light source close to the displayed artwork, providing a sense of intimacy with the displayed artwork, and inviting an observer to stand close for a look. It is known to incorporate lighting elements, within or behind a frame, at one or preferably multiple locations about the periphery of the displayed artwork. Examples of such devices are shown in U.S. Pat. No. 4,989,122 to Allekotte et al., U.S. Pat. No. 5,247,745 to Valentino, U.S. Pat. No. 5,265,357 to Yu, U.S. Pat. No. 7,080,918 to Rowland, Jr. et al., and U.S. Pat. No. 7,661,216 to Wampler. The foregoing are examples only, as a number of other patents exist in this general area. However, many of these patents describe a design in which areas close to the edge of the displayed artwork, adjacent to the frame, are over-illuminated, thereby washing out the colors in this area with bright light, and areas far from the edge are under-illuminated. This, of course, is detrimental to the goal of bringing out the best in the displayed artwork.

It is therefore an object of the present invention to improve upon existing designs of illuminated frames, prevent over-illumination in areas of the displayed artwork and achieve illumination evenly across the entire visible surface of the artwork.

SUMMARY OF THE INVENTION

The present invention is that of a frame, designed such that the artwork within the frame is illuminated evenly across the entire visible surface of the artwork by a light source within the frame shining through a lens.

In the preferred embodiment the frame is comprised of four wooden members, each attached at either end to two other members forming a rectangular frame. The artwork is placed in the center of the members. Each member has two thin openings running along the front face of the member along its length and an outer ridge along the top face of the outer edge of the member.

On two opposing members, a linear Fresnel lens, or another equivalent linear collimating lens, is placed in the member's inner openings. Preferably the lower edge of the lens is placed close to the upper surface of the artwork. In the same member's outer opening, a printed circuit board with a series of LEDs as light sources is placed facing towards the lens. The LEDs are placed a distance from the lens, generally in the range of 0-2 focal lengths but preferably at one focal length. The point light from the LEDs is collimated when passing through the lens and thereby directed into rays parallel to the surface of the artwork. This allows the light to spread along the entire surface of the artwork without excessively lighting areas near the light source.

A glass plate is placed within the outer edges of the members and close to the upper side of the lens. The light from the LEDs and lens reflects and scatters off the glass plate, contributing to an even illumination of the artwork. Another set of four aesthetic wooden members can be placed above the first set of members creating an aesthetic frame on the front of the inventive frame and also creating a cavity between the upper and lower members to hold the glass plate in place. The upper surface of the lower wooden members and the lower surface of the glass plate within the cavity are provided with an anti-reflective material or coating to limit the ability of uncollimated light to reach the artwork.

DETAILED DESCRIPTION OF THE INVENTION

Figure 1:
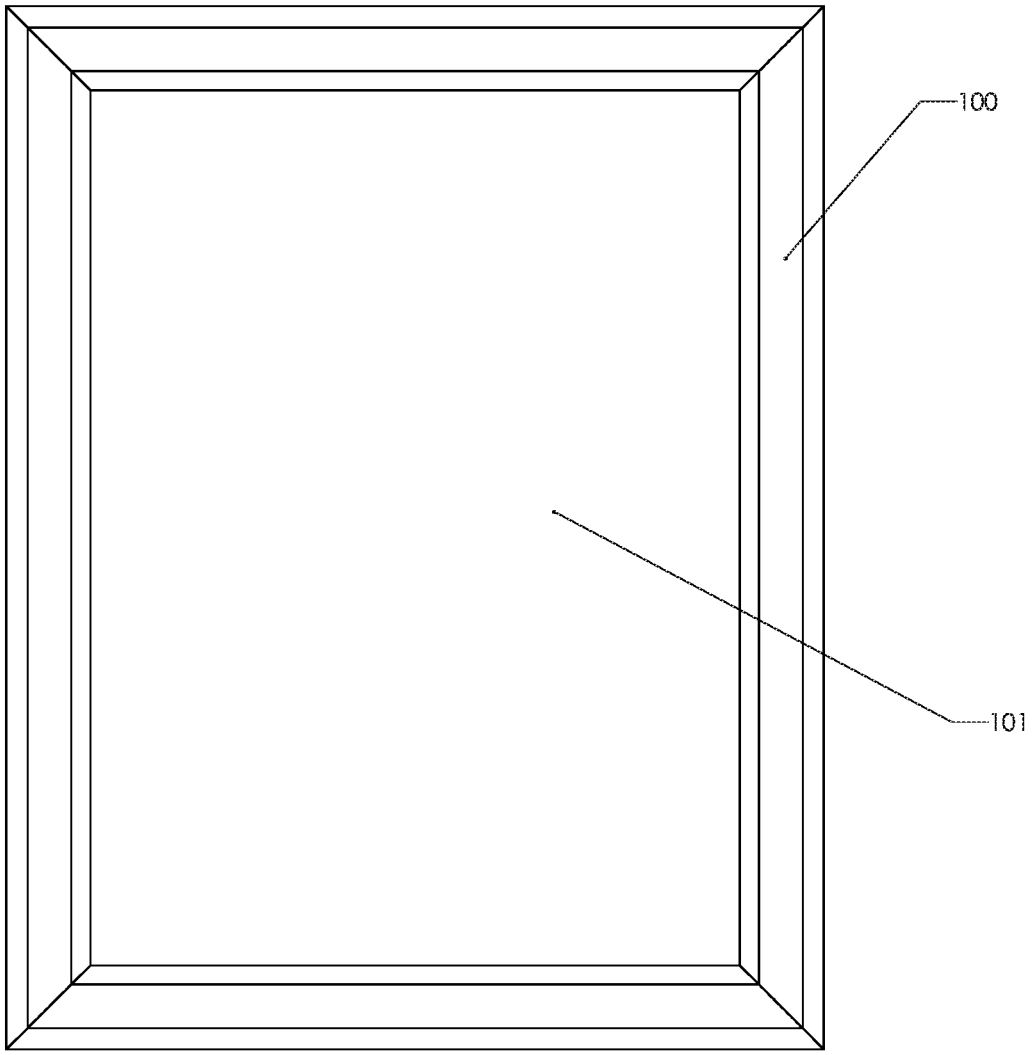
FIG. 1 is a front view of the frame and the aesthetic frame.
Figure 2:
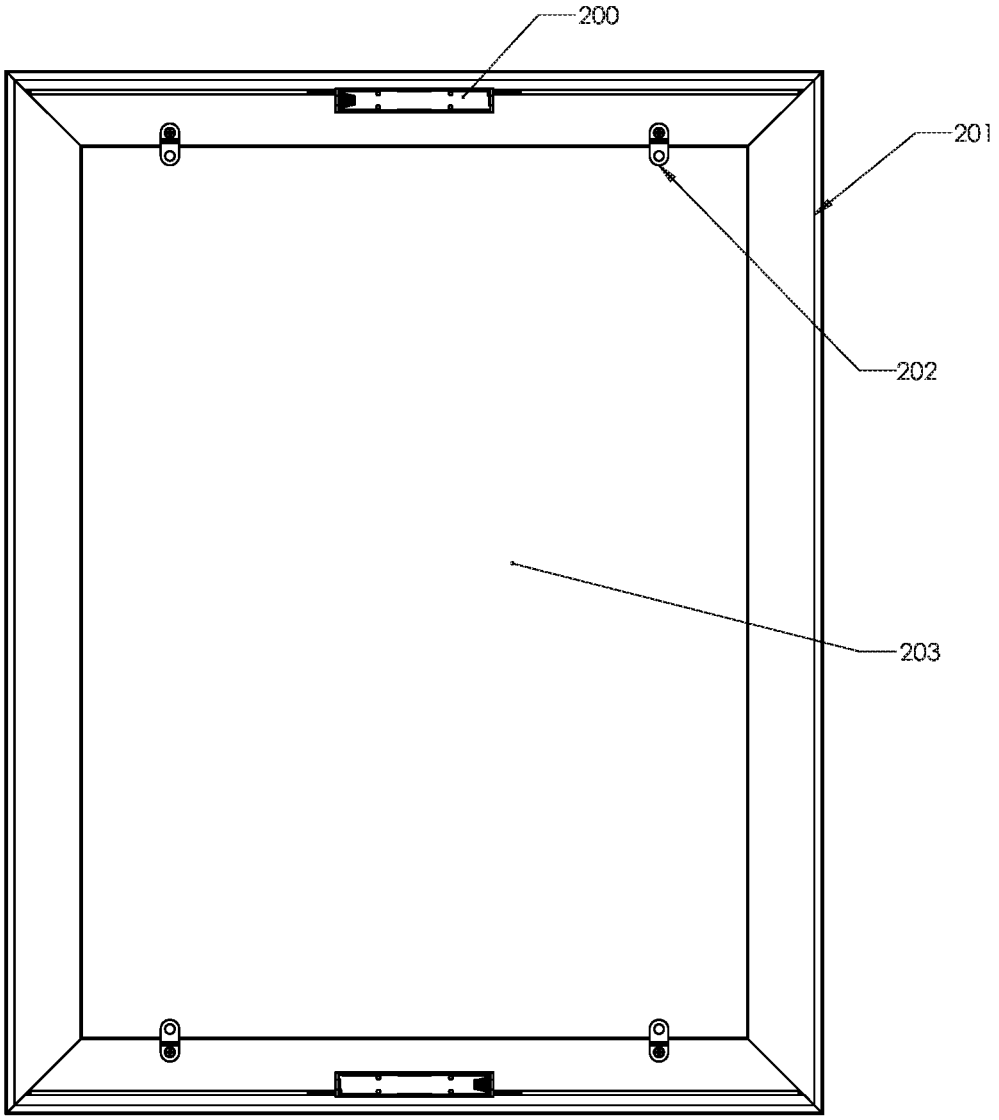
FIG. 2 is a rear view of the frame showing the use of an optional battery case and brackets to hold the artwork in place.

Referring now to the Figures, FIGS. 1 and 2 show a frame in accordance with one embodiment of the present disclosure. In FIGS. 1 and 2, the frame is shown with a typical piece of artwork 101, 203 displayed within the frame. In FIG. 1 the four aesthetic frame members in the preferred embodiment are shown around the edges of the artwork. In this embodiment both sets of frame members have beveled edges to connect corner to corner. The lengths of the frame members will match the size of the artwork being displayed. Therefore, the frame may be either square or rectangular, and if rectangular, then it may be in either a portrait or landscape orientation. In the preferred embodiment the members of both frames are made of wood. In some embodiments the members of both or either frames are made of plastic or aluminum, which in some embodiments are made by extrusion. The aesthetic frame is shown at 100.

In FIG. 2, the four functional frame members 201 are shown behind the aesthetic frame members. In two of the frame members, a battery case 200 is shown to provide power to the electrical elements of the frame. The preferred embodiment shows a case for standard disposable batteries. In some embodiments, rechargeable batteries with a port for an external power or direct current from a transformer taking power from a standard electrical outlet may be used instead. The preferred embodiment shows two power sources, but one power source could be used depending on the power requirements. Also shown are brackets 202 for attaching the artwork to frame members. Brackets are used in the preferred embodiment but in other embodiments a metal bracket that fits into a slit in the functional frame, an adhesive, nails, staples, or other method of securing the artwork or other item to be displayed to the frame could be used.

Figure 3:
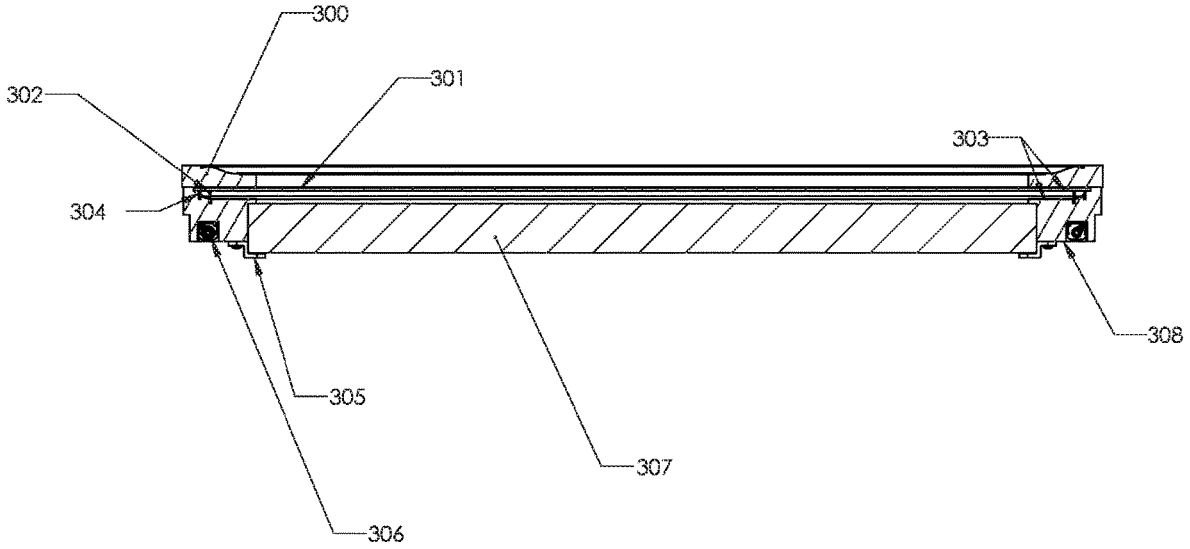
FIG. 3 is a side section view of the frame, showing the full frame assembly.
Figure 4:
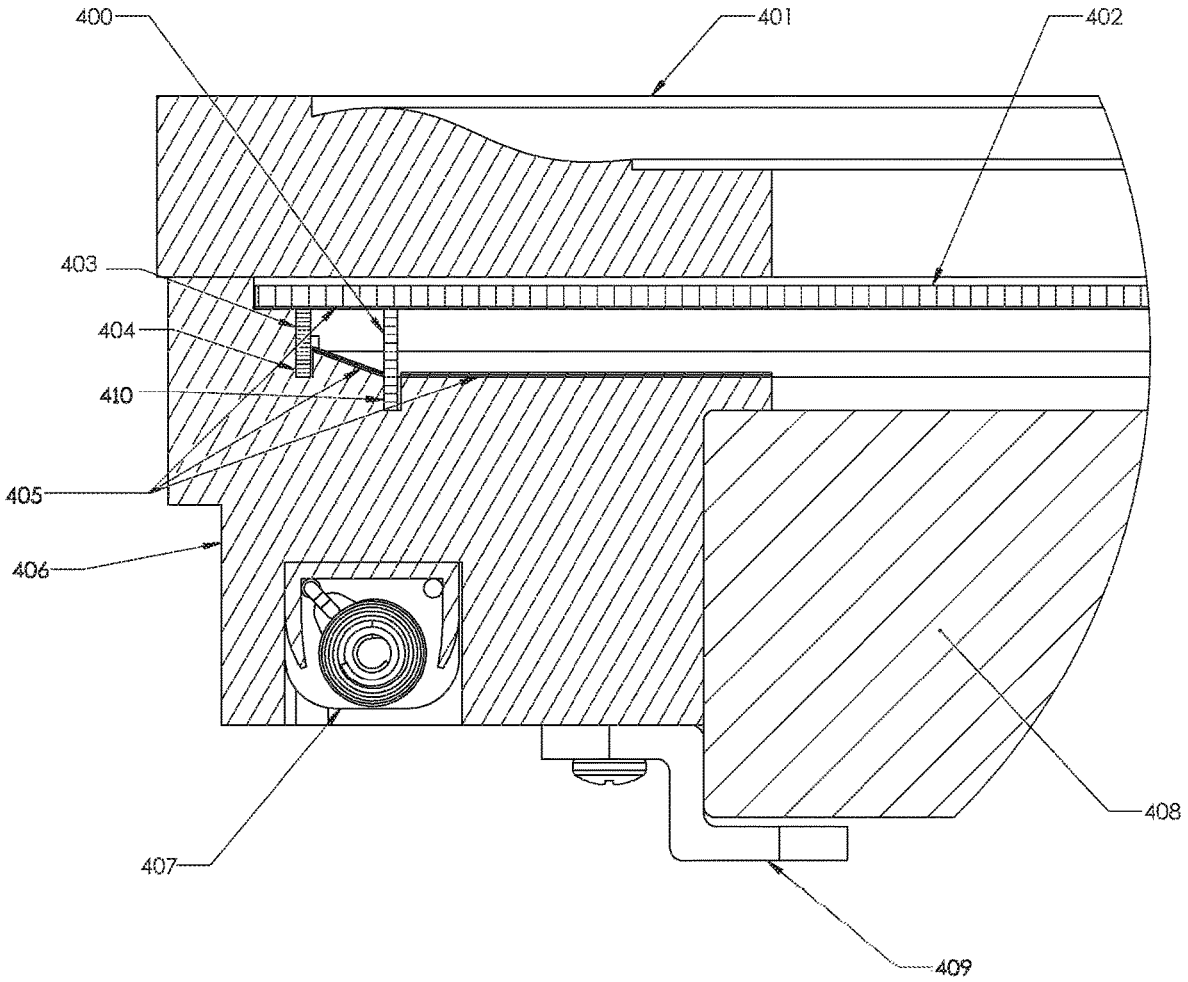
FIG. 4 is a detailed view of the FIG. 3 side section view.

FIGS. 3 and 4 show members of the frame 308 and the aesthetic frame 300 in a section view, the aesthetic frame 401 sitting above the functional frame. The artwork 307, 408 and bracket 305, 409 can be seen, with a screw securing the bracket 305, 409 to the frame member 406. There is a lip on the frame overhanging the artwork that allows the displayed surface of the artwork to be close to the lower edge of the lens, though the frame's illumination works at any depth. The battery case 306, 407 is also shown. The shapes of the functional frame member and the aesthetic frame member create an open cavity between the two members. Within this cavity on the frame member are two thin openings 302, 304, 404, 410 that run along the length of the member. In the outer opening 304, 404 a printed circuit board (PCB) is placed. On that PCB, a series of discrete LEDs 403 or other light sources are arranged in a linear fashion and facing inwards towards the artwork such that the artwork is illuminated by the light source. In the preferred embodiment, a linear Fresnel lens 400 (a flat cylindrical lens) is placed in the inner opening 302, 410, though in other embodiments other collimating lenses can be used. As the light from the LEDs passes through, the lens collimates the light rays to travel generally parallel to the displayed surface of the artwork, allowing much of the light to bypass the nearby portion of the artwork and instead reach the more distant portions of the artwork which are more difficult to light adequately. In the preferred embodiment the lens is placed at a distance to the LEDs equal to the focal length of the lens, though other embodiments may use a distance between 0 and 2 focal lengths. On the frame there is an outer ridge. Within the outer ridge a glass plate 301, 402 or other transparent plate sits above the artwork, and below the aesthetic frame 300. The glass plate sits close to the ridged portion on the lens. The beam light from the LEDs and lens reflects and scatters off this glass plate across the entire length of the artwork, contributing to an even illumination of the artwork.

Figure 8:
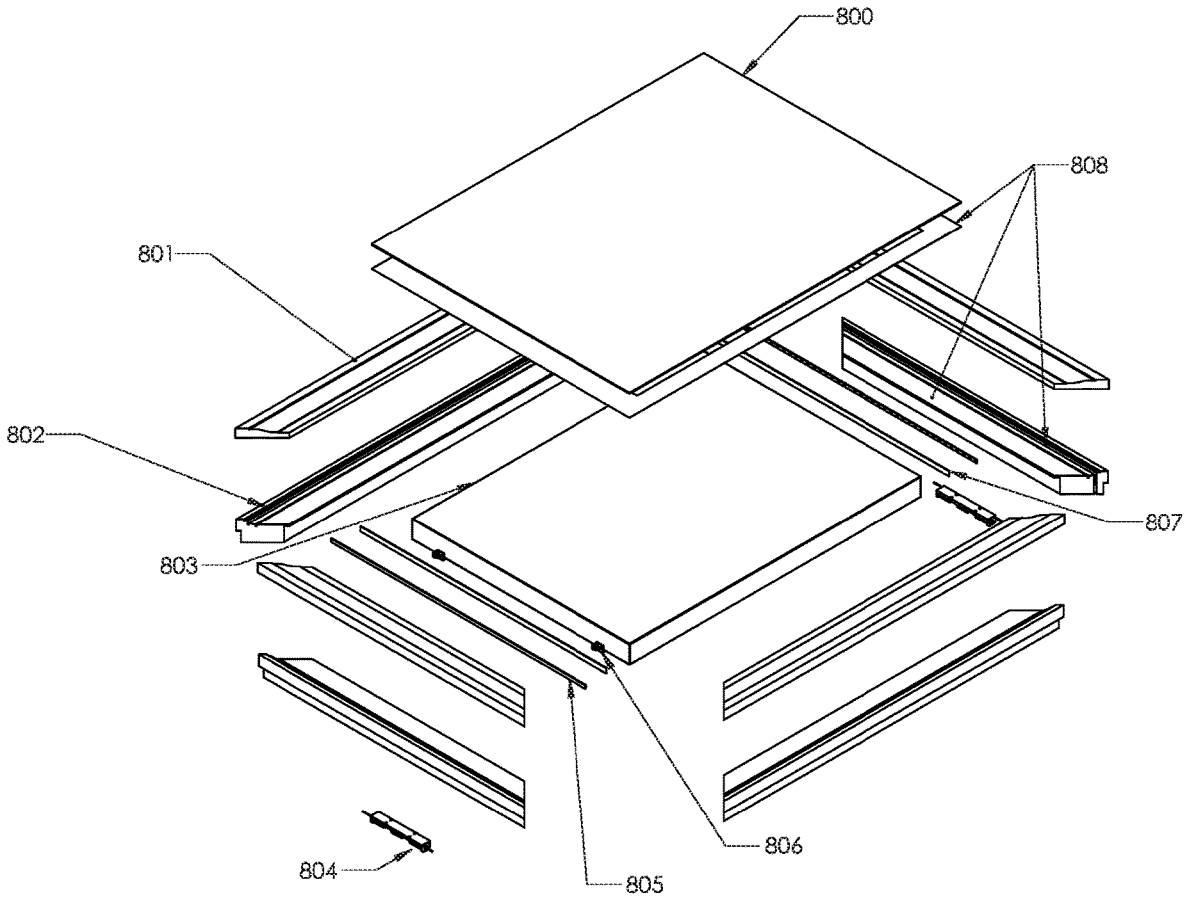
FIG. 8 is an exploded view of the full frame assembly.

FIG. 8. shows that in the preferred embodiment, the assembly of PCB and lens 805, 807 is placed on two opposite sides of the artwork 803. In the preferred embodiment the assemblies will be placed in the top and bottom members of the functional frame, for smaller artwork, illumination just from above is preferred, in some embodiments the left and right members of the frame will be used, and in some embodiments all four members have the assembly. In some embodiments, the members without the assembly may have reflective material covering the cavity to aid the illumination of longer pieces of artwork.

FIGS. 3 and 4 also show that the inside surface of the cavity, meaning the upper surface of the functional frame and the lower surface of the portion of the glass plate covered by the aesthetic frame 300, are coated with an anti-reflective material 303, 405. The purpose of this is to minimize the amount of light reaching the artwork which has not been columnated by the lens. In the preferred embodiment this material is a polyurethane foam or a "super black" paint, but any highly light absorbing material would be suitable. The characteristics of these materials trap and absorb the majority of the light which strikes them, preventing secondary illumination of the areas of the displayed surface of the artwork directly adjacent to the frame caused by light reflecting off of the bottom surface of the glass plate or the top surface of the functional frame. This secondary illumination would cause a bright area to appear on the areas of the displayed surface of the artwork directly adjacent to the frame, and by removing secondary illumination the artwork is lit evenly over the entire displayed surface.

In some embodiments, an alternative construction of the assembly is used. Instead of rigid lenses and PCBs fit into openings on the functional frame, flexible versions of those parts could be used instead. These thin, flexible versions could be produced and shipped as a roll and cut to length during production. Instead of being placed directly into the functional frame, the flexible parts could be placed in a plastic or metal extrusion that provides more stability to the thin parts. The extrusion would then be fit into a larger cavity on the functional frame. This extrusion could be incorporated into the frame if the frame in that embodiment is itself an extrusion.

Figure 5:
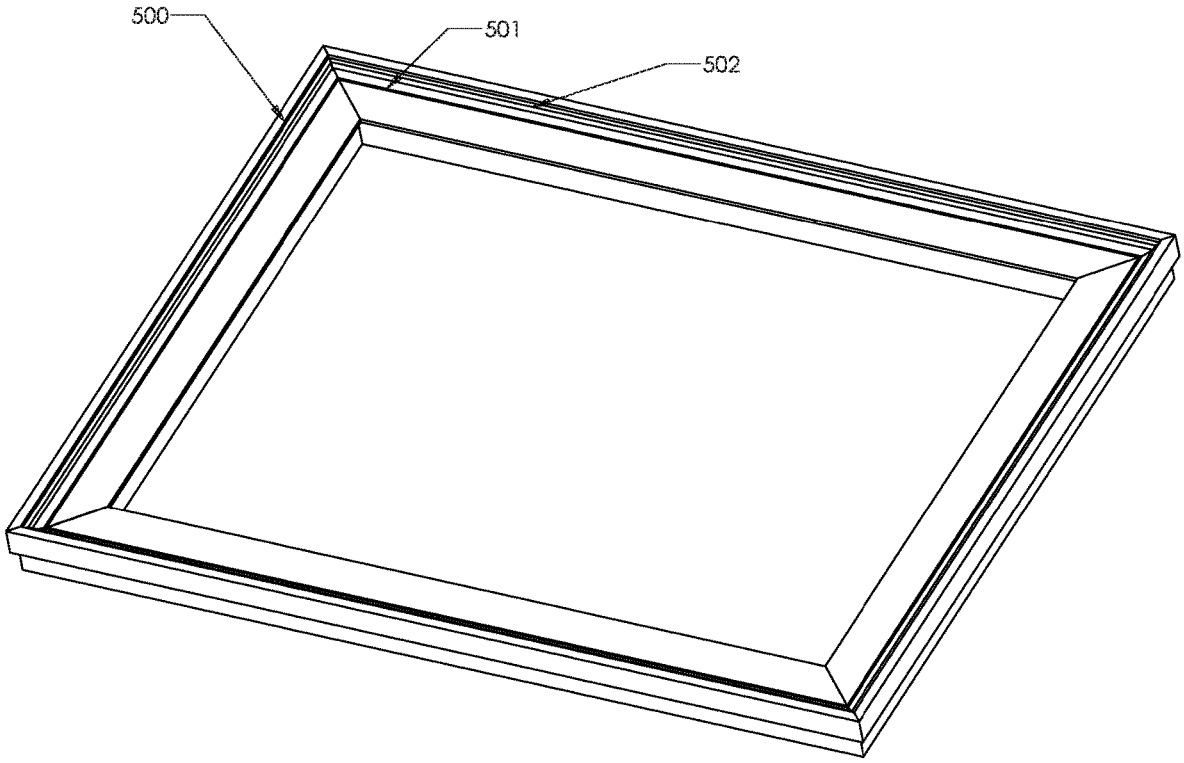
FIG. 5 is an elevated oblique view of the assembled frame showing the openings for the LEDs and lenses.

FIG. 5. Shows the functional frame members. Visible are the thin openings 501, 502 for the lens and the PCB with the LEDS used in this embodiment. The opening for the lens is closer to the artwork, while the opening for the PCB is further away, in this embodiment at a distance equal to the focal length of the lens. Both openings run the entire length of their member. In some embodiments, the opening for the PCB could be replaced with a wall that the back surface of the PCB is adhered to. Around the outer edge of the members, an outer ridge 500 that is integral to the function frame members creates an outer perimeter that prevents motion of the glass plate. In some embodiments the ridge is integral to the aesthetic frame instead.

Figure 6:
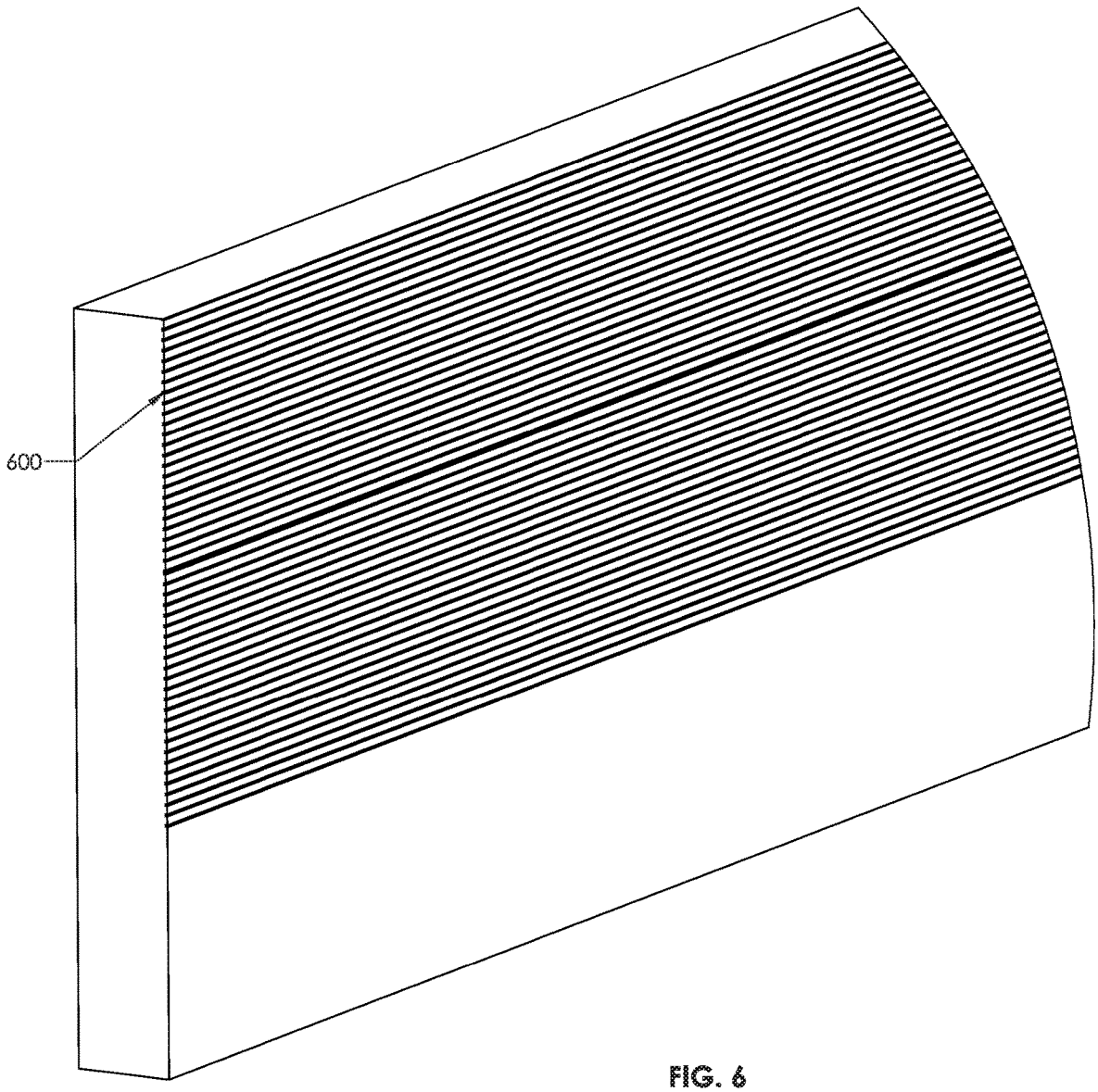
FIG. 6 is an oblique view of the Fresnel lens showing the etched ridges on the lens.
Figure 7:
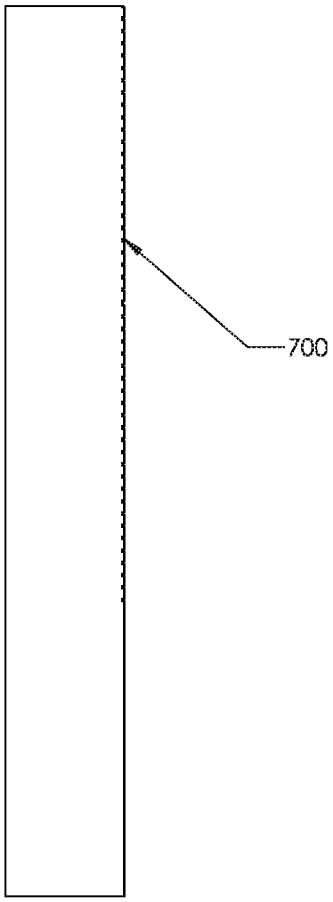
FIG. 7 is an end view of the Fresnel lens.

FIGS. 6 and 7 show the Fresnel lens used in the preferred embodiment. Visible are etched ridges 600, 700 that form the active portion on the lens and allow the lens to mimic the properties of a cylindrical lens while being much thinner than a standard cylindrical lens. Below the etched ridges is the inactive portion of the lens, which sits in the opening for the lens and brings the center of the lens to the correct height outside of the opening. Other embodiments may use a cylindrical lens or a different collimating lens. The ridges are on one side of the lens and begin at the top edge of the lens which allows the glass plate to be close to the active portion of the lens.

FIG. 8 shows an exploded view of all the parts of the frame. Around the edges are the four members of the functional frame 802 and the four members of the aesthetic frame 801. In the center is the displayed artwork 803. The PCB and lenses 805, 807 are shown a distance of one focal length as per the preferred embodiment. The battery cases 804 are shown beneath the functional frame. Also shown are brackets 806 for attaching the artwork to frame members.

The glass plate 800 appears above the artwork. Just beneath the glass plate is the anti-reflective material 808. In this figure the shape of the anti-reflective material on the glass plate in the preferred embodiment is visible as covering the bottom of the glass plate from the edge of the plate to a certain distance from the edge all around.

Figure 9:
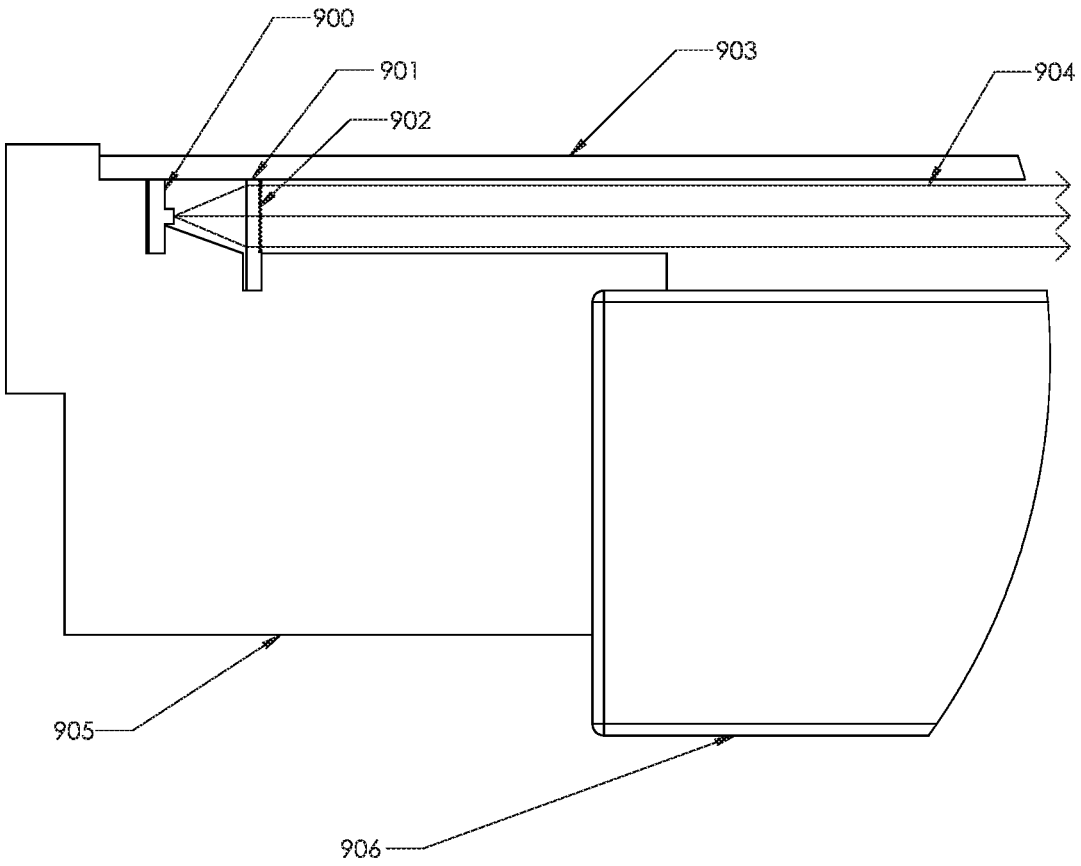
FIG. 9 is a detailed side view of the frame showing the placement of the LEDs and the lenses.

FIG. 9 shows a schematic view of the light rays. Within the cavity of functional frame 905 on the frame member are thin openings including 902 that run along the length of the member. LEDs 900 or other light sources are arranged in a linear fashion and facing inwards towards artwork 906 such that the artwork is illuminated by the light source. Linear lens 901 is placed in the inner opening 902, A glass plate 903 or other transparent plate sits above artwork 906. The light generated by the LED's 900 spreads out in many different directions. Because of the etched ridges on the edge forming the active portion of the lens, 901 the light rays 904 that pass through the active portion of the lens are collimated such that they exit the lens moving parallel or close to parallel to the displayed surface of the artwork. This allows more light to reach more distant areas of the artwork and gives an even amount of illumination to the entire surface of the outwork.

Although a specific embodiment of the invention has been disclosed herein, it is to be understood that various modifications can be made to the described embodiments without departing from the scope of the claimed invention, which modifications would be apparent to one skilled in this art area.

The invention claimed is:

1. An illuminated frame for displaying artwork including a light source and a collimating lens located on a front surface of the artwork to direct light rays from the light source to provide a uniform level of illumination across the entire surface of the artwork, wherein the light source and the collimating lens are attached to horizontal frame members and vertical frame members, the collimating lens having etched edges, wherein a plurality of light sources and a plurality of collimating lenses are placed in linear openings of the frame members and the plurality of collimating lenses are placed in the linear openings with the etched edges facing the displayed artwork.

2. The illuminated frame in accordance with claim 1 wherein anti-reflective material is applied to selected surfaces of the frame to prevent light from the light source from being reflected from the selected surfaces and over-illuminating the displayed artwork.

3. The illuminated frame in accordance with claim 1 wherein the distance between the light source and the collimating lens is between 0-2 focal lengths.

4. The illuminated frame in accordance with claim 1 wherein each frame member has the linear openings extending along a front face of the member for the entire length of the member.

5. The illuminated frame in accordance with claim 2 wherein the light source is an LED.

6. The illuminated frame in accordance with claim 3 wherein a glass plate is placed over the top of the displayed artwork.

7. The illuminated frame in accordance with claim 5 wherein the collimating lens is a Fresnel lens.

8. The illuminated frame in accordance with claim 6 wherein anti-reflective material is applied to a lower surface of the glass plate.

9. The illuminated frame in accordance with claim 8 wherein the frame is comprised of a first set of four members, each attached at either end to two other members to form a rectangular frame.

10. The illuminated frame in accordance with claim 9 wherein a set of four aesthetic members are placed above the first set of members to create a cavity between the first set of members and the set of aesthetic members into which the glass plate is inserted to hold the glass plate in place.

* * * * *